US009890920B2

(12) United States Patent
Kaneko et al.

(10) Patent No.: US 9,890,920 B2
(45) Date of Patent: Feb. 13, 2018

(54) VEHICULAR LAMP

(71) Applicant: Koito Manufacturing Co., Ltd., Tokyo (JP)

(72) Inventors: Susumu Kaneko, Shizuoka (JP); Kyouhei Akiyama, Shizuoka (JP); Takayuki Suzuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 175 days.

(21) Appl. No.: 14/849,759

(22) Filed: Sep. 10, 2015

(65) Prior Publication Data

US 2016/0084467 A1 Mar. 24, 2016

(30) Foreign Application Priority Data

Sep. 19, 2014 (JP) ..... 2014-191862

(51) Int. Cl.
*F21V 9/00* (2015.01)
*F21S 8/10* (2006.01)
*F21Y 115/10* (2016.01)

(52) U.S. Cl.
CPC ..... *F21S 48/225* (2013.01); *F21S 48/218* (2013.01); *F21S 48/2281* (2013.01);
(Continued)

(58) Field of Classification Search
CPC .... F21S 48/215; F21S 48/218; F21S 48/2212; F21S 48/225; F21S 48/2281; F21Y 2115/10
(Continued)

(56) References Cited

U.S. PATENT DOCUMENTS 5,938,324 A * 8/1999 Salmon ..... G01D 11/28 362/551
7,290,906 B2 11/2007 Suzuki et al.
(Continued)

FOREIGN PATENT DOCUMENTS

DE 10037005 A 2/2002
DE 10231326 A 2/2004
(Continued)

OTHER PUBLICATIONS

An Office Action dated Dec. 28, 2016, issued from the German Patent and Trade Mark Office (DPMA) of German Patent Application No. 10 2015 218 056.5 and an EN translation thereof.

*Primary Examiner* — Tsion Tumebo
(74) *Attorney, Agent, or Firm* — Abelman, Frayne & Schwab

(57) ABSTRACT

A vehicular lamp includes a plurality of light sources arranged in a row; and a light guide configured to receive light emitted from the light sources on a rear surface thereof, and emit the light from a front surface thereof. The light guide includes: a base having a rear surface extending in an arrangement direction of the light sources; a plurality of rear surface projections protruding from the rear surface of the base; and a plurality of front surface projections protruding from a front surface of the base. The rear surface projections and the front surface projections are arranged in the arrangement direction to be spaced apart from one another, and are formed in a plurality of projection forming areas, respectively. Each of the front surface projections has a polyhedral shape including a plurality of faces that are successive in a circumferential direction thereof.

14 Claims, 6 Drawing Sheets

1

(52) U.S. Cl.
CPC ..... *F21S 48/215* (2013.01); *F21S 48/2212* (2013.01); *F21Y 2115/10* (2016.08)

(58) Field of Classification Search
USPC ..... 362/511
See application file for complete search history.

(56) References Cited

U.S. PATENT DOCUMENTS

| | | | | |
|---|---|---|---|---|
| 7,670,039 | B2 * | 3/2010 | Altonen | G02B 6/0001 200/314 |
| 2013/0021815 | A1 * | 1/2013 | Koizumi | F21S 48/215 362/511 |

FOREIGN PATENT DOCUMENTS

| | | | |
|---|---|---|---|
| DE | 102007019688 | A | 10/2008 |
| DE | 102008037264 | A | 2/2010 |
| DE | 202013001767 | A | 3/2013 |
| EP | 2363738 | A | 9/2011 |
| JP | 2003-141909 | A | 5/2003 |
| JP | 2005-347144 | A | 12/2005 |

* cited by examiner

VEHICULAR LAMP

CROSS-REFERENCE TO RELATED APPLICATIONS

This application is based on and claims priority from Japanese Patent Application No. 2014-191862, filed on Sep. 19, 2014, with the Japan Patent Office, the disclosure of which is incorporated herein in its entirety by reference.

TECHNICAL FIELD

The present disclosure relates to a vehicular lamp used in, for example, an automobile.

BACKGROUND

As a light source of a vehicular lamp, a semiconductor light source such as, for example, a light emitting diode (LED) or a semiconductor laser, is being used, in lieu of a conventional bulb such as, for example, an incandescent bulb. Such a semiconductor light source has various advantages, such as for example, a variety of designs through a combination with light guides or high power saving, as compared to a bulb. See, for example, Japanese Patent Laid-Open Publication No. 2003-141909 and Japanese Patent Laid-Open Publication No. 2005-347144.

SUMMARY

A vehicular lamp using a conventional semiconductor light source has been developed, focusing on uniform light emission with a reduced point light feeling. In other words, a light emission pattern is monotonous and there remains room for improvement in terms of a high quality feeling.

The present disclosure has been made in view of the foregoing circumstances, and one of illustrative objects of an exemplary embodiment thereof is to provide a vehicular lamp capable of creating a jewel-like brilliancy when the vehicular lamp is turned on and/or off.

An aspect of the present disclosure relates to a vehicular lamp. The vehicular lamp includes: a plurality of light sources arranged in a row; a light guide configured to receive light emitted from the plurality of light sources on a rear surface thereof, and emit the light from a front surface thereof. The light guide includes: a base having a rear surface facing the plurality of light sources and extending in an arrangement direction of the plurality of light sources; a plurality of rear surface projections protruding from the rear surface of the base; and a plurality of front surface projections protruding from a front surface of the base. The plurality of rear surface projections and the plurality of front surface projections are arranged in the arrangement direction to be spaced apart from one another, and are formed in a plurality of projection forming areas, respectively. Each of the projection forming areas has a cross section, in which a side in a width direction of the base, which is perpendicular to the arrangement direction, becomes a longer side. Each of the plurality of front surface projections has a polyhedral shape including a plurality of faces that are successive in a circumferential direction thereof.

According to this aspect, when the vehicular lamp is turned on, the light emitted from a light source and incident on a rear surface projection is introduced into a front surface projection and multiple-reflected by the plurality of faces of the polyhedral front surface projection, so that a jewel-like brilliancy may be created. In addition, when the vehicular lamp is turned off, external light such as, for example, sunlight, is incident on the plurality of faces of the polyhedral front surface projection, such that a jewel-like glittering effect may be created.

Each of the plurality of faces of the front surface projection may have a concave shape in the width direction thereof. Due to the concave face, when external light such as, for example, sunlight is incident thereon, the light may be refracted to be diffused in the width direction, thereby enhancing the jewel-like brilliancy, as compared to a case in which the front surface projection is formed to have a convex shape so as to collect light.

The plurality of faces of the front surface projection may be successive in the circumferential direction along the front surface of the base.

The plurality of rear surface projections may include: a plurality of first projections, each of which is disposed on or adjacent to an optical axis of a corresponding one of the plurality of light sources; and a plurality of second projections, each of which is disposed between two adjacent first projections. A tip end of each of the plurality of first projections has a convex shape, and a tip end of each of the plurality of second projections has a concave shape. With this arrangement, each of the first projections may collect light mainly from one corresponding light source and each of the second projections may collect light obliquely incident thereon from two adjacent light sources, thereby uniformly illuminating the light guide.

The base of the light guide may have a cross-section, of which the front surface is convex. By forming the front surface projections on the curved surface, a three-dimensional effect may be enhanced.

The vehicular lamp may further include an inner lens inserted between the plurality of light sources and the light guide. By inserting the inner lens, the light from the light source may be incident on the light guide in a state where the light is diffused and the effective directivity of the light is diminished. Accordingly, a point light feeling may be reduced and the light may be uniformly emitted throughout the vehicular lamp. In addition, the light may be incident on the front surface projections from various directions and may be multi-reflected therein so that the jewel-tone brilliancy may be made conspicuous.

In the inner lens, cylindrical steps may be formed on the rear surface of the inner lens which faces the plurality of light sources, to be successive in the arrangement direction of the light sources. In this way, the light from the light sources may be properly diffused.

At least one of the plurality of front surface projections may be formed in an eleven-sided shape, except the bottom face thereof.

An area of the front surface of the base between each two adjacent projection forming areas may be subjected to a diffusion processing. Accordingly, a portion that emits light in a jewel tone and a portion that emits light in a matt tone may appear alternately. Thus, the jewel tone may further be enhanced due to the contrast between the portions.

The plurality of front surface projections may gradually vary in shape in the direction in the arrangement direction. In this way, the jewel tone suitable for a design of a vehicular lamp may be created.

Another aspect of the present disclosure relates to a vehicular lamp. The vehicular lamp includes: a plurality of light sources arranged in a row; a light guide configured to receive light emitted from the plurality of light sources on a rear surface thereof, and emit the light from a front surface thereof. The light guide includes: a base having a rear surface facing the plurality of light sources and extending in an arrangement direction of the plurality of light sources; and a plurality of front surface projections protruding from a front surface of the base. The plurality of front surface projections are arranged in the arrangement direction to be spaced apart from one another, and are formed in a plurality of projection forming areas, respectively. Each of the projection forming areas having a cross section, of which a side in a width direction of the base, which is perpendicular to the arrangement direction, becomes a longer side. Each of the plurality of front surface projections has a polyhedral shape including a plurality of faces that are successive in a circumferential direction thereof.

Meanwhile, optionally combining aforementioned components or substituting components or expressions of the present disclosure among, for example, a method, an apparatus, and a system, is also effective as an embodiment of the present disclosure.

According to the aspects of the present disclosure, a jewel-like brilliancy may be created.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
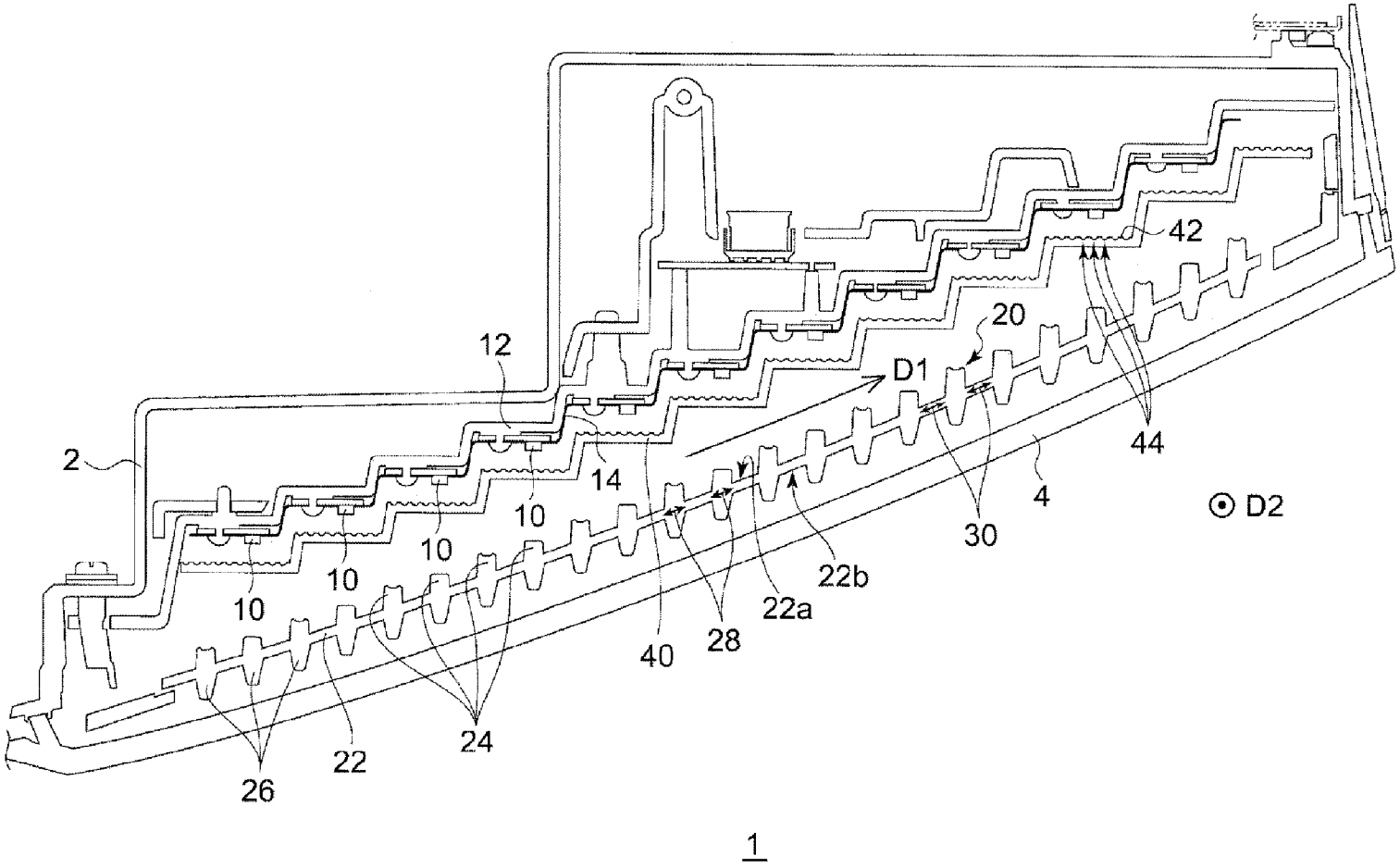
FIG. 1 is a horizontal cross-sectional view illustrating a vehicular lamp according to an exemplary embodiment.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here. In the following description and drawings, the same components will be denoted by the same reference numerals.

FIG. 1 is a horizontal cross-sectional view illustrating a vehicular lamp according to an exemplary embodiment. In the present exemplary embodiment, a tail lamp will be described as the vehicular lamp by way of an example.

The vehicular lamp 1 includes a lamp body 2, a cover (outer lens) 4, a plurality of light sources 10, a support member 12, a light guide 20, and an inner lens 40. The light sources 10, the support member 12, the light guide 20, and the inner lens 40 are disposed within a lamp chamber formed by the lamp body 2 and the cover 4.

The plurality of light sources 10 are arranged in a row to be spaced apart from each other according to a desired light emission pattern. An irradiation direction of the light sources 10 is aligned to face a front of the vehicular lamp 1 (a rear of a vehicle). The light sources 10 are semiconductor light sources such as, for example, light emitting diodes (LEDs) or semiconductor lasers, and are mounted on a flexible board 14. The flexible board 14 is mounted to conform to the support member 12. Thus, the plurality of light sources 10 are supported by the support member 12 in a stepped form. The light guide 20 receives a light emitted from the plurality of light sources 10 on the rear surface thereof, and outputs the light from the front surface thereof.

The inner lens 40 is inserted between the plurality of light sources 10 and the light guide 20 so as to diffuse the light emitted from the light source 10 by refraction and introduce the light into the rear surface of the light guide 20. Cylindrical steps 44 may be formed on a rear surface 42 of the inner lens 40 which faces the plurality of light sources 10 to be successive in a direction D1 in which the light sources 10 are arranged (hereinafter, referred to as an "arrangement direction D1"). Through the cylindrical steps 44, the light emitted from the plurality of light sources 10 may be appropriately diffused in a transverse direction so as to be uniformly introduced into the light guide 20. The light emitted from the front surface of the light guide 20 is irradiated toward the rear side of the vehicle through the cover 4.

Subsequently, descriptions will be made on a configuration of the light guide 20. The light guide 20 includes a base 22, a plurality of rear surface projections (rear surface ribs) 24, and a plurality of front surface projections (front surface ribs) 26. The base 22 has a reverse surface 22*a* extends in the arrangement direction of the light sources 10 (see, e.g., arrow D1 in FIG. 1) to face the plurality of light sources 10.

The plurality of the rear surface projections 24 are formed to be directed toward the light sources 10 from the rear surface 22*a* of the base 22. On the other hand, the plurality of front surface projections 26 are formed to be directed toward the irradiation direction of the light sources 10 (toward the rear side of the vehicle) from the front surface 22*b* of the base 22.

The plurality of rear surface projections 24 are arranged to be spaced apart from each other and the plurality of front surface projections 26 are arranged to be spaced apart from one another, in the arrangement direction D1 of the light sources 10. The plurality of rear surface projections 24 and the plurality of front surface projections 26 are formed in a plurality of projection forming areas 28 of the base 22. Each of the projection forming areas 28 has a cross section, in which a side in a width direction of the base 22 becomes a longer side. The width direction refers to a direction perpendicular to the arrangement direction D1 and corresponding to the height direction of the vehicle (indicated by arrow D2 in FIG. 2A).

Figure 2B:
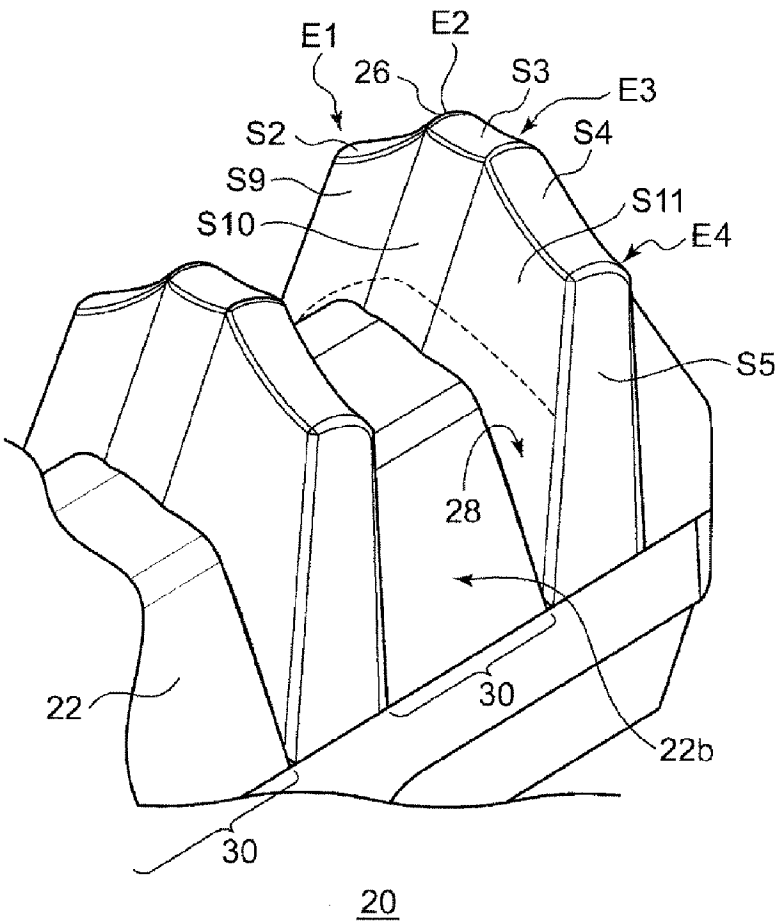
FIGS. 2A and 2B are perspective views illustrating a light guide as viewed from a front surface side.
Figure 2A:
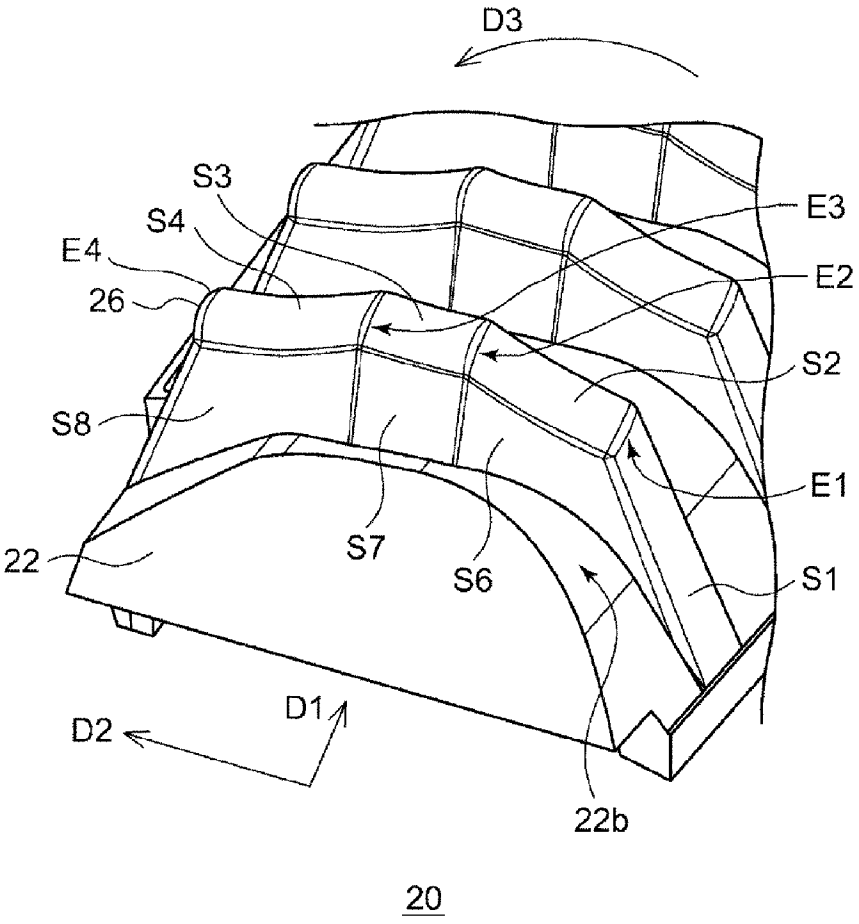

FIGS. 2A and 2B are perspective views illustrating the light guide 20 as viewed from the front surface side. FIG. 2B illustrates the front surface projections 26 as viewed in a direction opposite to that of FIG. 2A. Each of the plurality of front surface projections 26 has a polyhedral shape. The polyhedral shape includes a plurality of faces (hereinafter, also referred to as circumferential faces) S1 to S5 which are successive in a circumferential direction (indicated by arrow D3 in FIG. 2A) at least along the front surface 22*b* of the base 22. In the present exemplary embodiment, the front surface projection 26 is formed in an eleven-sided shape (S1 to S11), except the bottom face thereof (the projection forming area 28), and in addition to circumferential faces S1 to S5, includes side faces S6 to S8 and S9 to S11.

An area 30 between each two adjacent projection forming areas 28 on the front surface 22*b* of the base 22 is subjected to a diffusion processing (embossing processing).

Figure 3:
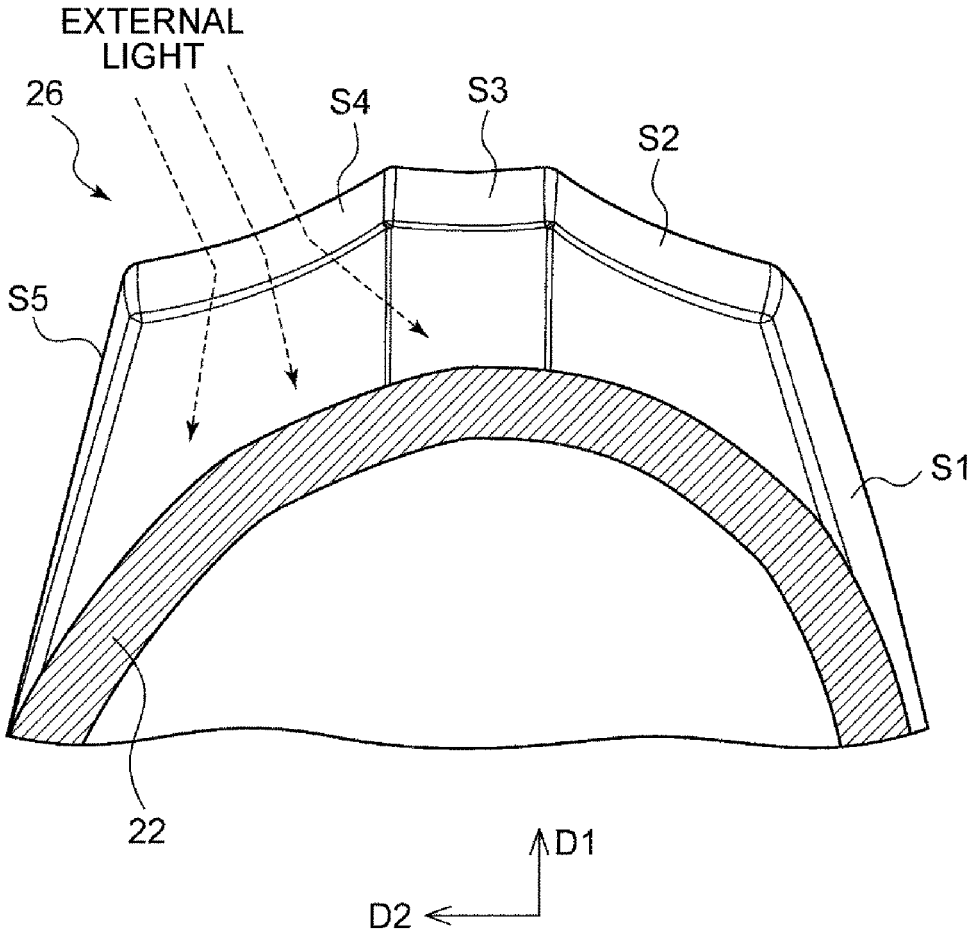
FIG. 3 is a perspective view illustrating a front surface projection of the light guide as viewed in a direction different from those of FIGS. 2A and 2B.

FIG. 3 is a perspective view illustrating a front surface projection 26 of the light guide 20 as viewed in a direction different from those of FIGS. 2A and 2B. Among the circumferential faces S1 to S5, the circumferential faces S2 to S4 that correspond to the front side when viewed from the rear side of the vehicle have a concave shape with respect to the width direction D2 of the base 22. The radius of curvature of the circumferential faces S2 to S4 may be, for example, about 10 cm.

As indicated by hatching in FIG. 3, the base 22 may have a curved cross section (hatched portion) in which the front surface 22*b* is convex and the rear surface 22*a* is concave. When the front surface projection 26 is formed on the convexly curved surface, a three-dimensional effect created by the front surface projection 26 is further enhanced.

Figure 4:
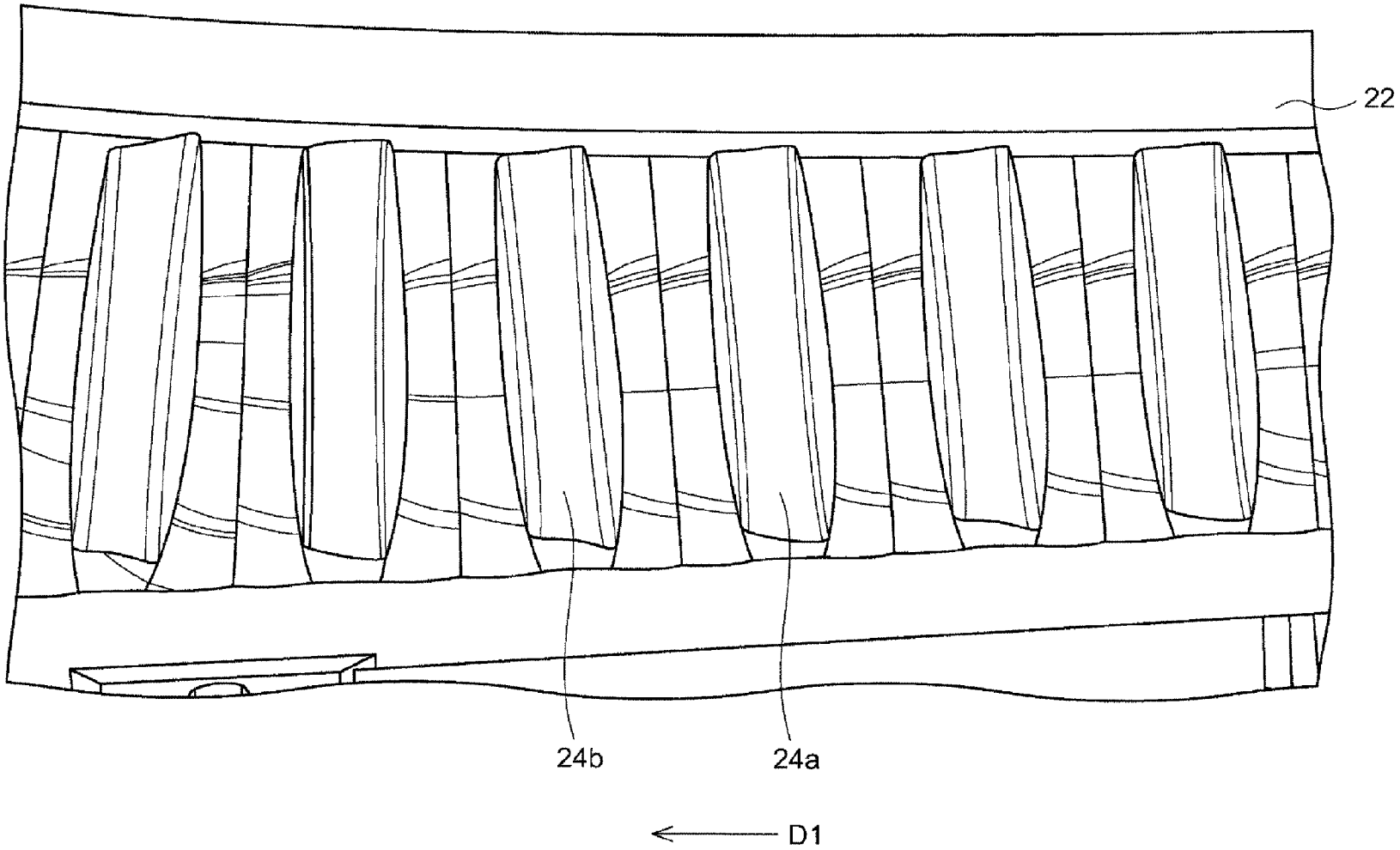
FIG. 4 is a view illustrating a portion of the light guide as viewed from a rear surface side.
Figure 5:
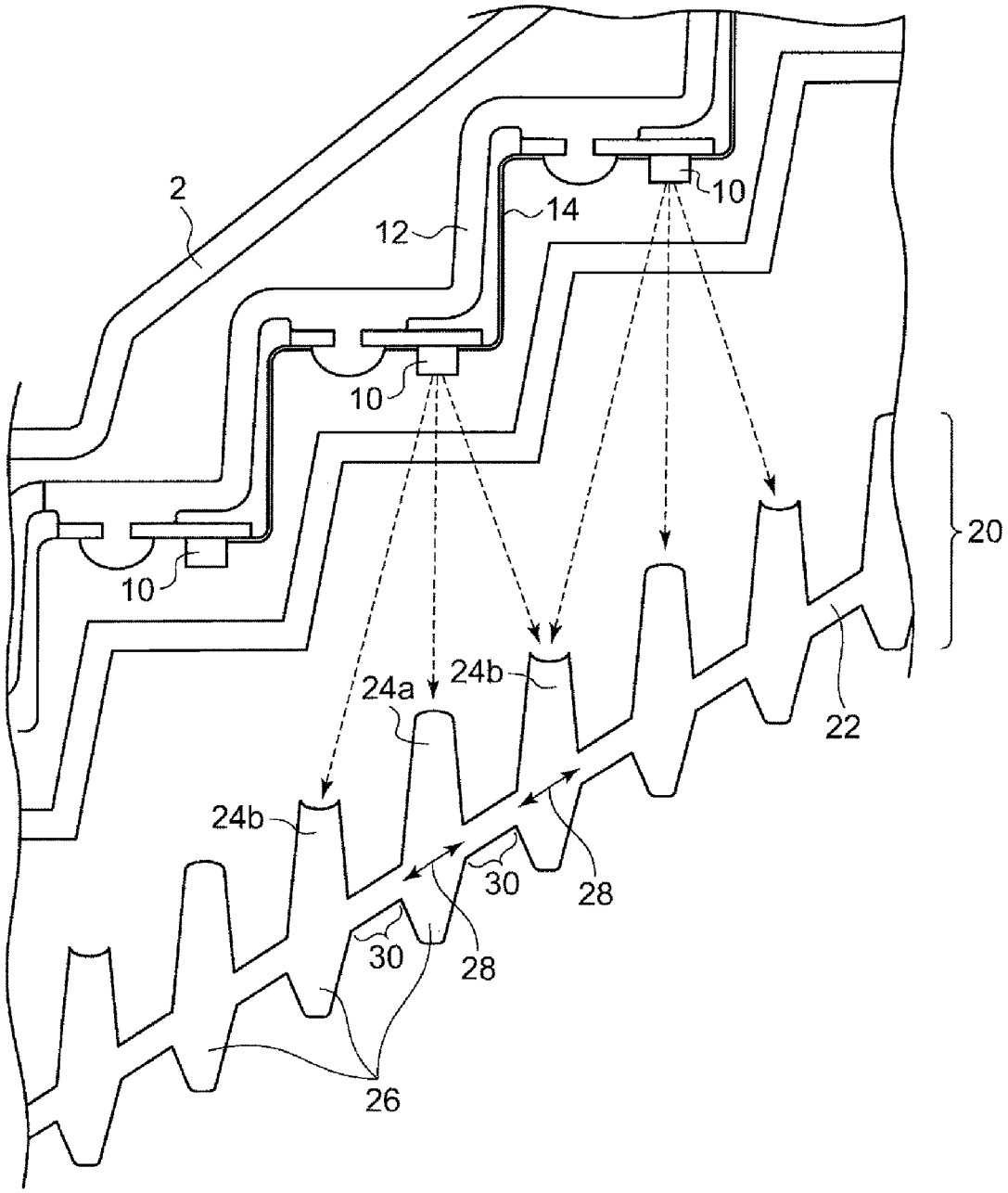
FIG. 5 is a view illustrating a positional relationship between the light guide and light sources.

Subsequently, descriptions will be made the rear surface projections 24. FIG. 4 is a view illustrating a portion of the light guide 20 as viewed from the rear surface side. FIG. 5 is a view illustrating a positional relationship between the light guide 20 and the light sources 10. The plurality of rear surface projections 24 include a plurality of first projections 24*a* and a plurality of second projections 24*b* which are alternately arranged in the arrangement direction D1 of the light sources 10. Each of the first projections 24*a* is disposed on or adjacent to the optical axis of corresponding one of the plurality of light sources 10. Meanwhile, each of the second projections 24*b* is disposed between two adjacent first projections 24*a*. Each of the tip ends of the plurality of first projections 24*a* has a convex shape, and each of the tip ends of the plurality of second projections 24*b* has a concave shape. In other words, by the first projections 24*a* and the second projections 24*b*, convex steps and concave steps are alternately formed in the arrangement direction D1 of the light sources 10.

In the foregoing, the configuration of the vehicular lamp 1 has been described. Subsequently, descriptions will be made on an operation of the vehicular lamp 1.

As illustrated in FIG. 5, the light emitted from the light source 10 is diffused by the inner lens 40 and is incident on the rear surface projections 24 of the light guide 20. Due to the inserted inner lens 40, each rear surface projection 24 receives light incident thereon at various angles.

The light incident on the rear surface projections 24 progresses toward the rear side of the vehicle while being multiple-reflected within the base 22. In detail, a portion of the light is introduced into the front surface projections 26, and the remainder of the light is leaked to areas other than the projection forming areas 28 of the base 22. The light introduced into the front surface projections 26 is irradiated to the rear side of the vehicle through the front surfaces of the front surface projections 26. In addition, the areas 30 emit light dimly due to the light leaked to the areas 30.

With the vehicular lamp 1, the following effects may be obtained.

When the vehicular lamp 1 is turned on, the light emitted from the light sources 10 and incident on the rear surface projections 24 is introduced into the front surface projection 26 and the light is multiple-reflected by the plurality of faces of the polyhedral front surface projections 26 such that surface emission with the jewel-like brilliancy and three-dimensional surface emitting may be realized. In addition, when the vehicular lamp 1 is turned off, external light such as, for example, sunlight, is multi-reflected from the plurality of faces of the polyhedral front surface projections 26 and is introduced into the front surface projections 26 to be multiple-reflected therein such that the jewel-like brilliancy may be realized.

In the vehicular lamp 1, as illustrated in FIG. 3, the circumferential faces S2, S3, and S4 of the front surface projection 26 have a concave shape in the width direction D2. Thus, when the external light such as, for example, sunlight, is incident on the front surface projection 26, the light is refracted to be diffused with respect to the width direction D2, and the jewel-like brilliancy may be enhanced, as compared to a case in which an front surface projection has convex faces in the width direction D2 so as to collect light.

In the vehicular lamp 1, as illustrated in FIG. 5, the rear surface projections 24 are arranged such that the first projections 24*a* and the second projections 24*b* are alternately arranged. Thus, each first projection 24*a* may collect the light mainly emitted from one light source 10, of which the optical axis is shared with the first projection 24*a*, and each second projection 24*b* may collect the light obliquely incident thereon from two adjacent light sources 10 so that the light guide 20 may be uniformly illuminated. In other words, in the present exemplary embodiment, regular and uniform light emission may be achieved by a relatively small number of light sources 10, as compared to a case in which the number of rear surface projections 24 is the same as the number of light sources 10 so that the rear surface projections 24 and the light sources 10 are in a one-to-one correspondence. In addition, by disposing two front surface projections 26 with respect to one light source 10, the jewel tone brilliancy may further be enhanced.

As illustrated in FIG. 3, the base 22 is formed to have a curved cross section so that its front surface 22*b* has a convex shape. By forming the front surface projection 26 on such a curved surface of the base 22, the three-dimensional effect may be enhanced.

In addition, by inserting the inner lens 40 between the plurality of light sources 10 and the light guide 20, the light emitted from the light source 10 may be diffused in multi-directions and effective directivity may be diminished. Accordingly, the point light feeling may be reduced, and the vehicular lamp 1 may emit light uniformly. Moreover, since the light is incident on the front surface projection 26 in various directions and is multiple-reflected therein, the jewel-like brilliancy may be made conspicuous.

The aforementioned jewel-like brilliancy or three-dimensional effect may contribute to creating a high quality feeling in the vehicle and produce a relatively high added value, in addition to the original function of the vehicular lamp 1 of increasing the safety of the vehicle.

The areas 30 between the projection forming areas 28 of the obverse surface 22*b* of the base 22 are subjected to an embossing process. Through the embossing process, the portions emitting light in a jewel tone (the projection forming areas 28) and the portions emitting light in a matt tone (the areas 30 between the projection forming areas 28) appear alternately, and due to the contrast therebetween, the jewel tone may be further enhanced and the three-dimensional effect may be created.

The present disclosure has been described above based on an exemplary embodiment. It may be understood by a person ordinarily skilled in the art that the exemplary embodiment is provided merely for the purposes of illustration, and that various modifications may be made through a combination of respective components and the modifications also belong to the scope of the present disclosure. Hereinafter, such modifications will be described.

(Modification 1)

While the exemplary embodiment described above forms the front surface projection 26 in an eleven-sided shape, the shape of the front surface projection 26 is not limited thereto. For example, side faces S6 to S8 may form a single plane, and similarly, side faces S8 to S11 opposite to the side faces S6 to S8 may also form a single plane.

(Modification 2)

Figure 6:
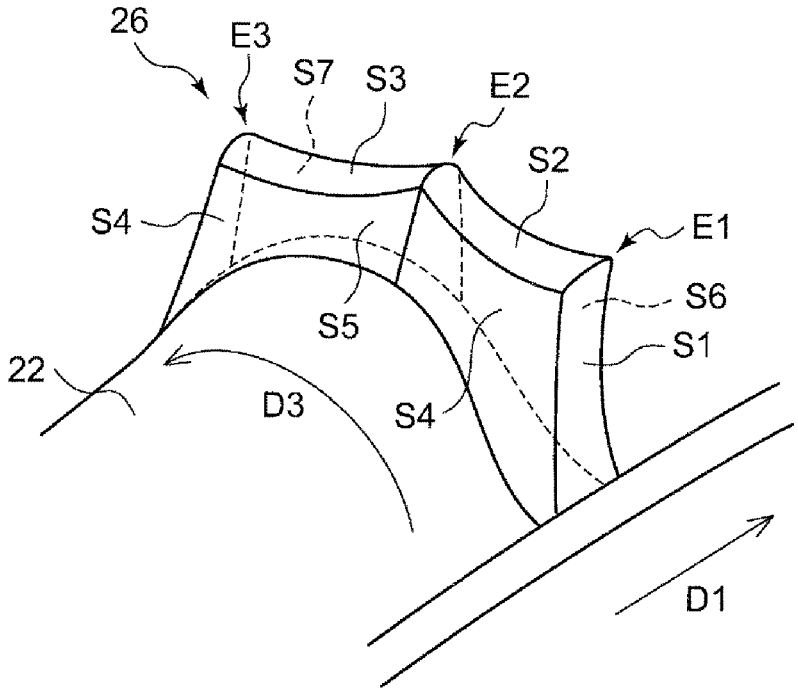
FIG. 6 is a perspective view illustrating a front surface projection according to a modification.

FIG. 6 is a perspective view illustrating a front surface projection 26 according to a modification. As illustrated in FIG. 6, the number of circumferential faces of the front surface projection 26 which are successive in the circumferential direction D3 of the front surface projection 26 may be four. In this case, the front surface projection 26 may have an eight-sided shape, except the bottom face thereof. Alternatively, the number of faces that are successive in the circumferential direction D3 may be six or more.

It may be appreciated that the aforementioned jewel-tone brilliancy is created by edges E1 to E4 defining boundaries of the circumferential faces S1 to S5 (S1 to S4) of FIGS. 2A and 2B, and edges E1 to E3 defining boundaries of circumferential faces S1 to S4 of FIG. 6. In this regard, the number of edges defining boundaries of the circumferential faces may be at least two, and more particularly, three or more.

Alternatively, the front surface projection 26 of FIG. 6 and the front surface projection 26 of FIG. 2 may be used in combination. In addition, in a case where front surface projections 26 having different shapes are formed in combination, the shapes of the plurality of front surface projections 26 may gradually and successively vary in the arrangement direction D1 of light sources 10. Accordingly, different jewel tones, in which a portion of a vehicular lamp 1 has a fine jewel tone and another portion of the vehicular lamp 1 has a rough jewel tone, may be created.

(Modification 3)

In a case where the directivity of the light sources 10 is not so strong, the inner lens 40 may be omitted.

(Modification 4)

Although a tail lamp has been described as one type of the vehicular lamp 1 in the exemplary embodiment described above, the present disclosure may be applied to a rear combination lamp which is disposed in a corner of a vehicle.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicular lamp comprising:

a plurality of light sources arranged in a row; and a light guide configured to receive light emitted from the plurality of light sources on a rear surface thereof, and emit the light from a front surface thereof, wherein the light guide includes:

a base having a rear surface facing the plurality of light sources and a curved cross section in which a front surface thereof has a convex shape, and extending in an arrangement direction of the plurality of light sources;

a plurality of rear surface projections protruding from the rear surface of the base and including a plurality of first projections of which each tip end portion having a convex shape and a plurality of second projections of which each tip end portion having a concave shape, the plurality of first projections and the plurality of second projections being alternately arranged in the arrangement direction of the plurality of light sources; and a plurality of front surface projections protruding from the front surface of the base to be aligned with the plurality of rear surface projections, respectively, when viewed from a top, each of the plurality of front surface projections having a polyhedral shape including a plurality of faces that are successive in a circumferential direction along the front surface of the base, and a plurality of edges defining boundaries of the plurality of faces of the polyhedral shape in a width direction of the base, which is perpendicular to the arrangement direction of the plurality of light sources, wherein the plurality of rear surface projections and the plurality of front surface projections are arranged in the arrangement direction of the plurality of light sources to be spaced apart from one another, and are formed in a plurality of projection forming areas, respectively, each of the projection forming areas having a cross section where a length in the width direction of the base is longer than a length in the arrangement direction of the plurality of light sources, and the plurality of light sources and the plurality of first projections of the rear surface projections are configured to share an optical axis, respectively such that the plurality of first projections of the plurality of rear surface projections are configured to mainly collect light emitted from the plurality of light sources that shares the optical axis therewith, respectively, and the plurality of second projections of the plurality of rear surface projections are configured to collect light obliquely incident from two adjacent light sources of the plurality of light sources, respectively, thereby uniformly illuminating the light guide, and at least one of the plurality of faces of each of the plurality of front surface projections that is provided at a side of the front surface of the base is formed to have a concave shape in the width direction of the base such that an external light incident on the at least one of the plurality of faces of each of the plurality of front surface projections that is provided at a side of the front surface of the base is refracted to be diffused in the width direction of the base, thereby enhancing jewel-like brilliancy.

2. The vehicular lamp of claim 1, wherein each of the plurality of first projections is disposed on or adjacent to an optical axis of a corresponding one of the plurality of light sources.

3. The vehicular lamp of claim 1, further comprising:

an inner lens inserted between the plurality of light sources and the light guide.

4. The vehicular lamp of claim 1, wherein at least one of the plurality of front surface projections is formed in an eleven-sided shape, except a bottom face thereof.

5. The vehicular lamp of claim 1, wherein an area of the front surface of the base between each two adjacent projection forming areas is formed by an embossing processing.

6. The vehicular lamp of claim 1, wherein when the plurality of front surface projections have different shapes one another, a shape of the plurality of front surface projections gradually and successively varies in the arrangement direction of the plurality of light sources.

7. A vehicular lamp comprising:

a plurality of light sources arranged in a row; and a light guide configured to receive light emitted from the plurality of light sources on a rear surface thereof, and emit the light from a front surface thereof, wherein the light guide includes:

a base having a rear surface facing the plurality of light sources and a curved cross section in which a front surface thereof has a convex shape, and extending in an arrangement direction of the plurality of light sources, wherein a plurality of rear surface projections protrude from the rear surface of the base; and a plurality of front surface projections protruding from the front surface of the base to be aligned with the plurality of rear surface projections, each of the plurality of front surface projections having a polyhedral shape including a plurality of faces that gradually and successively vary in a circumferential direction along the front surface of the base, and a plurality of edges defining boundaries of the plurality of faces of the polyhedral shape in a width direction of the base, which is perpendicular to the arrangement direction of the plurality of light sources, wherein the plurality of front surface projections are arranged in the arrangement direction of the plurality of light sources to be spaced apart from one another, and are formed in a plurality of projection forming areas, respectively, each of the projection forming areas having a cross section where a length in the width direction of the base is longer than a length in the arrangement direction of the plurality of light sources, and at least one of the plurality of faces of each of the plurality of front surface projections that is provided at a side of the front surface of the base is formed to have a concave shape in the width direction of the base such that an external light incident on the at least one of the plurality of faces of each of the plurality of front surface projections that is provided at a side of the front surface of the base is refracted to be diffused in the width direction of the base, thereby enhancing jewel-like brilliancy.

8. The vehicular lamp of claim 7, wherein an area of the front surface of the base between each two adjacent projection forming areas is formed by an embossing process.

9. The vehicular lamp of claim 1, wherein the plurality of faces that are successive in the circumferential direction along the front surface of the base includes four faces.

10. The vehicular lamp of claim 7, wherein the plurality of faces that are successive in the circumferential direction along the front surface of the base includes four faces.

11. The vehicular lamp of claim 4, wherein the at least one of the plurality of front surface projections is formed in an eight-sided shape, except the bottom face thereof.

12. The vehicular lamp of claim 7, wherein at least one of the plurality of front surface projections is formed in an eight-sided shape, except a bottom face thereof.

13. The vehicular lamp of claim 1, the number of the plurality of edges of the polyhedral shape is two or more.

14. The vehicular lamp of claim 7, the number of the plurality of edges of the polyhedral shape is two or more.

* * * * *